US008297218B2

(12) United States Patent
Tanahashi et al.

(10) Patent No.: US 8,297,218 B2
(45) Date of Patent: Oct. 30, 2012

(54) COATING APPARATUS

(75) Inventors: Kiyokazu Tanahashi, Tokyo (JP); Kiyoshi Endo, Kanagawa (JP); Kazuhiko Sakata, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 551 days.

(21) Appl. No.: 12/303,965

(22) PCT Filed: May 25, 2007

(86) PCT No.: PCT/JP2007/060698

§ 371 (c)(1),
(2), (4) Date: Dec. 9, 2008

(87) PCT Pub. No.: WO2007/145067

PCT Pub. Date: Dec. 21, 2007

(65) Prior Publication Data

US 2010/0229791 A1 Sep. 16, 2010

(30) Foreign Application Priority Data

Jun. 12, 2006 (JP) ..... 2006-162025

(51) Int. Cl.
*B05B 1/02* (2006.01)

(52) U.S. Cl. ..... 118/313

(58) Field of Classification Search ..... 118/313
See application file for complete search history.

(56) References Cited

U.S. PATENT DOCUMENTS

| | | | | |
|---|---|---|---|---|
| 4,378,564 | A * | 3/1983 | Cross et al. | 347/54 |
| 5,300,558 | A * | 4/1994 | Kurisu et al. | 524/707 |
| 2004/0194710 | A1 * | 10/2004 | Hanamachi et al. | 118/728 |

FOREIGN PATENT DOCUMENTS

| | | |
|---|---|---|
| JP | 1986189726 | 11/1986 |
| JP | 1985202851 | 7/1987 |
| JP | 2003275647 | 9/2003 |
| JP | 2004152865 | 5/2004 |
| JP | 2005000856 | 1/2005 |

* cited by examiner

*Primary Examiner* — Dah-Wei Yuan
*Assistant Examiner* — Stephen Kitt
(74) *Attorney, Agent, or Firm* — Lucas & Mercanti, LLP

(57) ABSTRACT

A coating apparatus for conducting coating by discharging liquid droplets onto a substrate, is provided with a discharging head having an external terminal to receive control signals and a plurality of nozzles to discharge liquid droplets in response to the control signals; a drive control board to output the control signals to the discharging head; a cable to transmit the control signals from the drive control board to the discharging head; a relay board having a first terminal to form a first joint section to joint with the external terminal of the discharging head and a second terminal to form a second joint section to joint with the cable; and an intercepting member to intercept contact between the first joint section and outside air and to intercept contact between the second joint section and outside air.

9 Claims, 6 Drawing Sheets

COATING APPARATUS

This is a U.S. National Phase Application under 35 U.S.C. 371 of International Application PCT/JP2007/060698 filed on May 25, 2007, which claims the priority of Japanese Application No. 2006-162025, filed Jun. 12, 2006, the entire content of both Applications are hereby incorporated by reference.

TECHNICAL FIELD

The present invention relates to a coating apparatus to form a coating layer on a substrate by employing a liquid droplet discharging method, in particular, an ink jet coating method.

BACKGROUND ART

Conventionally, methods to coat a coating liquid on a substrate, are well known. For example, pre-metering and post-metering type coating methods. A pre-metering type coating method include an extrusion coating method, a slide coating method and a curtain coating method. These methods discharge a coating liquid only in an amount to form a necessary coating layer so as to coat the coating liquid on a substrate. A post-metering type coating method include a roll coating method, an air knife coating method and a wire bar coating method. These methods discharge a coating liquid in an amount more than necessary to form a coating layer in advance and thereafter scrape off excess coating liquid.

However, with the above methods, in many cases, it may be difficult to form a thin layer or to form a thin layer with a coating liquid having a low viscosity due to the configuration of coating apparatuses.

Recently, for the above problems, ink jet coating methods are used to form an image, a continuous layer and a patterned coating layer.

In the ink jet coating method, liquid droplets are discharged based on printing data onto a substrate from a discharging head (hereafter, also referred to an ink jet head) having a plurality of ink discharging nozzles so as to form a desired image or coating layer.

Hereafter, "ink" and "coating liquid", and "printing" and "coating" have the same meaning respectively.

An apparatus to coat an image or a coating layer on a wide substrate with the ink jet coating method, includes a shuttle type coating apparatus which conducts coating while shifting the discharging head in the conveying direction or the width direction of the substrate and a line head type coating apparatus which conducts coating with one or more discharging heads arranged in the width direction of the substrate so as to cover at least the coating width.

Further, the application of the ink jet coating method has been used for a thin film formation used for a display member. In particular, the application has been actively practiced to form a coating layer of organic EL elements used for a display.

As a usage for the above-mentioned display member, a coating layer formation has been conventionally widely conducted on a sheet-shaped substrate such as a glass plate. However, there have been problems in large-scale production. On the other hand, in order to respond to large-scale production, a technique to conduct coating continuously on a lengthy substrate such as a film having flexibility has been disclosed (for example, refer Patent document 1).

In the case of conducting coating continuously on the lengthy substrate such as a film having flexibility by employing the ink jet coating method, a great amount of organic solvent is used for a coating liquid. There is a fear that electrical joint sections in the discharging head or its peripheral portion may be deteriorated due to the organic solvent. As a result, there is a fear that malfunction may take place in the driving of the discharging head.

To counter the above problem, a discharging head equipped with a wiring section to supply electric energy to make a discharging head section to conduct ink discharging, a connecting section to connect electrically the discharging head section with the wiring section, and a sealing member to cover the connecting section and to seal a space among the discharging head section, members to surround the periphery of the discharging head and an attaching member has been disclosed (for example, refer to Patent document 2).

However, in Patent document 2, although the deterioration in an electrical connecting section in the discharging head is taken into consideration, this patent document does not teach a structure for a connecting section between the discharging head and a drive control board located outside of the discharging head. Therefore, there is a fear for the deterioration in the connecting section between the discharging head and the drive control board.

Patent document 1: Japanese Patent Unexamined Publication No. 2004-185951 (official gazette)

Patent document 2: Japanese Patent Unexamined Publication No. 5-38812 (official gazette)

DISCLOSURE OF THE INVENTION

Problem to be Solved by the Invention

An object of the present invention is to provide a coating apparatus to prevent the deterioration in electrical connections between a discharging head and a peripheral drive control board so as to make it possible to conduct coating stably even in the case where organic solvent is used for a coating liquid in an ink jet coating method and coating is conducted continuously for a lengthy substrate such as a flexible film.

Means for Solving the Problem

The above object can be attained by the following structures.

1. In a coating apparatus equipped with a discharging head having a plurality of nozzles to discharge liquid droplets and for conducting coating by discharging liquid droplets onto a substrate from the discharging head, the coating apparatus is characterized by comprising:

a relay board to connect the discharging head, a drive control board to control and drive the discharging head, and a cable to connect the relay board and the drive control board, wherein at a joint section between the discharging head and the relay board and at a joint section between the relay board and the cable, there is provided a intercepting member to intercept contact between the joint sections and outside air.

2. The coating apparatus described in Item 1 and characterized in that the intercepting member is a casing body composed of an insulating material and to enclose the joint sections.

3. The coating apparatus described in Item 2 and characterized in that the inside of the casing body is filled up with an inert gas.

4. The coating apparatus described in any one of Items 1 to 3 and characterized in that the intercepting member is composed of a heat curable insulating resin or a photo curable insulating resin.

Effect of the Invention

In the coating apparatus to coat a substrate by employing the ink jet coating method, at a joint section between the discharging head and the relay board and at a joint section between the relay board and the cable, there is provided a intercepting member to intercept contact between the joint sections and outside air so that vapor of a coating liquid can be prevented from coming in contact with the joint sections. Therefore, it becomes possible to avoid deterioration in electrical connection with electric members in a discharging head and a peripheral drive control board. Especially, in the case where organic solvent is used for a coating liquid and coating is conducted continuously for a lengthy substrate such as a film having flexibility. The present invention makes it possible to conduct stable coating.

Further, when the intercepting member is made as a casing body composed of an insulating material and encloses the joint sections, the inside of the casing body can be filled with an inert gas. The intercepting effect with the outside air of the intercepting member can be enhanced in this structure.

EXPLANATION OF SYMBOLS

Figure 1:
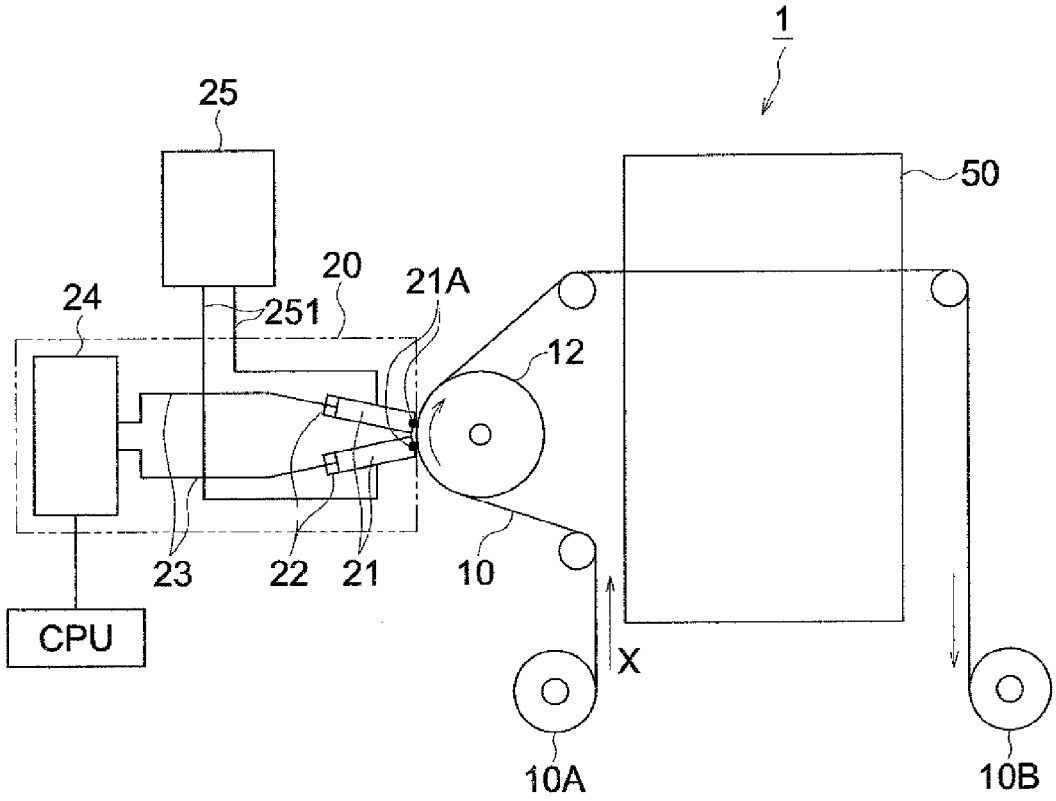
FIG. 1 is a schematic diagram showing an outline of a coating apparatus according to one embodiment of the present invention.

1 coating apparatus
10 substrate
12 back roller
20 supporting frame
21 discharging head
21A nozzles
21B external connector
22 relay board
23 cable
24 drive control board
25 coating liquid tank
50 intercepting member
51 first casing body
52 second casing body
60 filling member

BEST MODE FOR CARRYING OUT THE INVENTION

Hereafter, embodiments of the present invention will be explained with reference to drawing. However, the present invention is not limited to these embodiments.

FIG. 1 is a schematic diagram showing one example of a coating apparatus.

The coating apparatus 1 is a line head type coating apparatus in which one or more discharging heads having a plurality of nozzles are arranged in a width direction of a substrate 10 so as to form a predetermined coating width to conduct coating. In the present embodiment, a plurality of coating heads are arranged in a stagger arrangement.

The lengthy substrate 10, wound in a rolled form, is unwound from a supply roller 10A and conveyed in an arrowed direction X by a driving device not shown in the drawing.

The lengthy substrate 10 is conveyed around a back roller 12 to support the lengthy substrate 10 and is coated with a coating liquid discharged from the discharging head 21.

The discharging head 21 is fixed to a supporting frame 20 to hold the discharging head 21. As the discharging head 21, a well-known discharging head can be employed. For example, discharging heads equipped with piezoelectric elements or a heater may be employed as the discharging head 21.

A coating liquid is supplied to the discharging head 21 from a coating liquid tank 25 via a liquid feeding passage 251.

The discharging head 21 is connected to a drive control board 24 via a relay board 22 and a cable 23. The drive control board 24 is held by the supporting frame 20.

Figure 2:
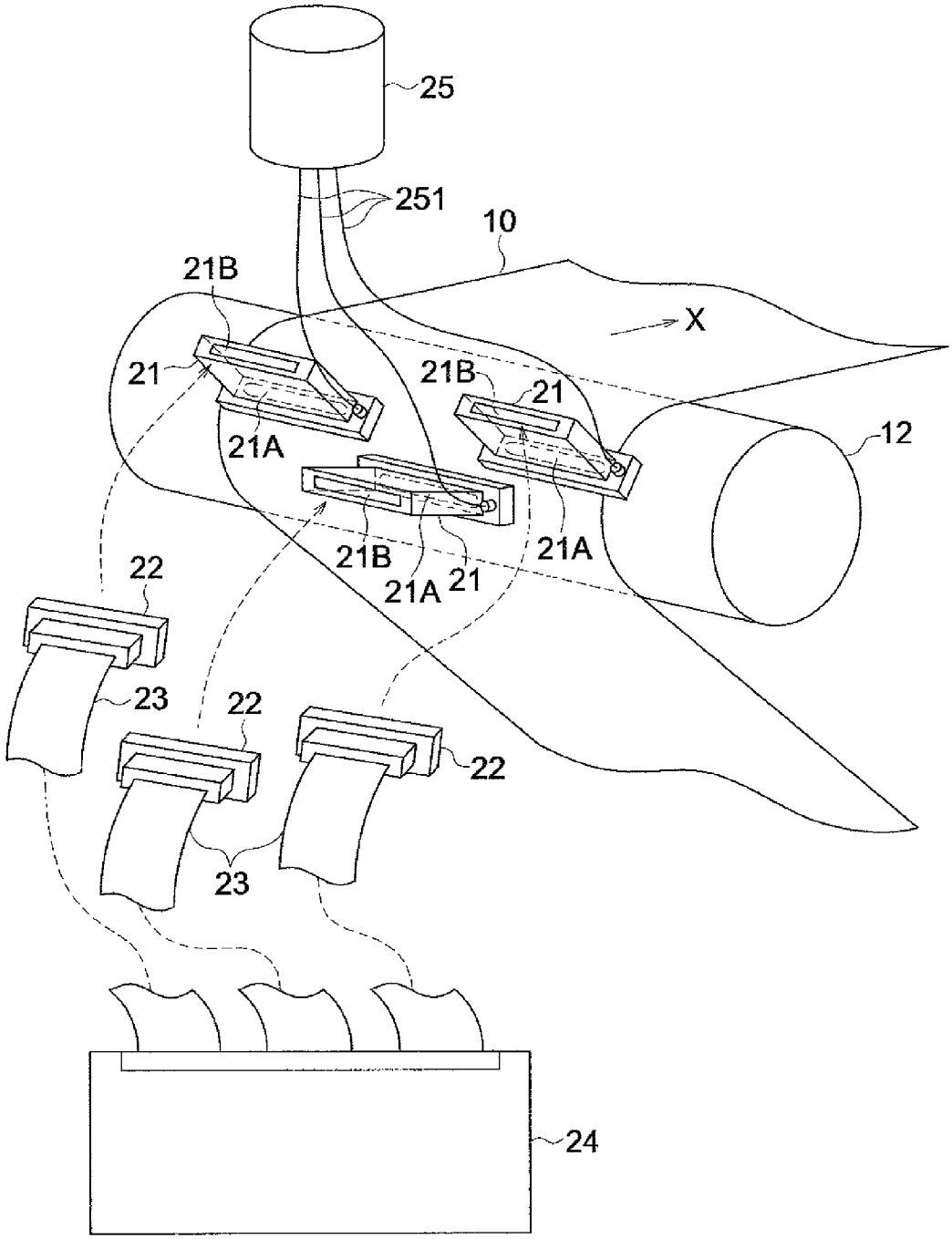
FIG. 2 is a perspective view showing an example of an arrangement of a discharging head according to one embodiment of the present invention.

FIG. 2 is a perspective view showing an example of an arrangement of a discharging head 21 of the coating apparatus 1 shown in FIG. 1. The substrate 10 is conveyed in an arrowed direction X while being supported by the back roller 12. The discharging head 21 is a head having a predetermined length, arranged at a position to oppose the back roller 12 so as to sandwich the substrate 10, and held by the supporting frame 20 (not shown in FIG. 2). A coating liquid is discharged toward almost the center of rotation of the back roller 12 from a nozzle section 21 A having a plurality of nozzles and coated onto the substrate 10. The arranged position of the discharging head 21 is not limited to the position shown in FIG. 2, and may be any position to oppose the back roller 12 so as to sandwich the substrate 10.

In the present embodiment, the substrate 10 is supported by the back roller 12 as stated above. However, the substrate 10 may be supported by a roller-shaped supporting member which is not rotatable or a straight line-shaped supporting member.

Figure 3:
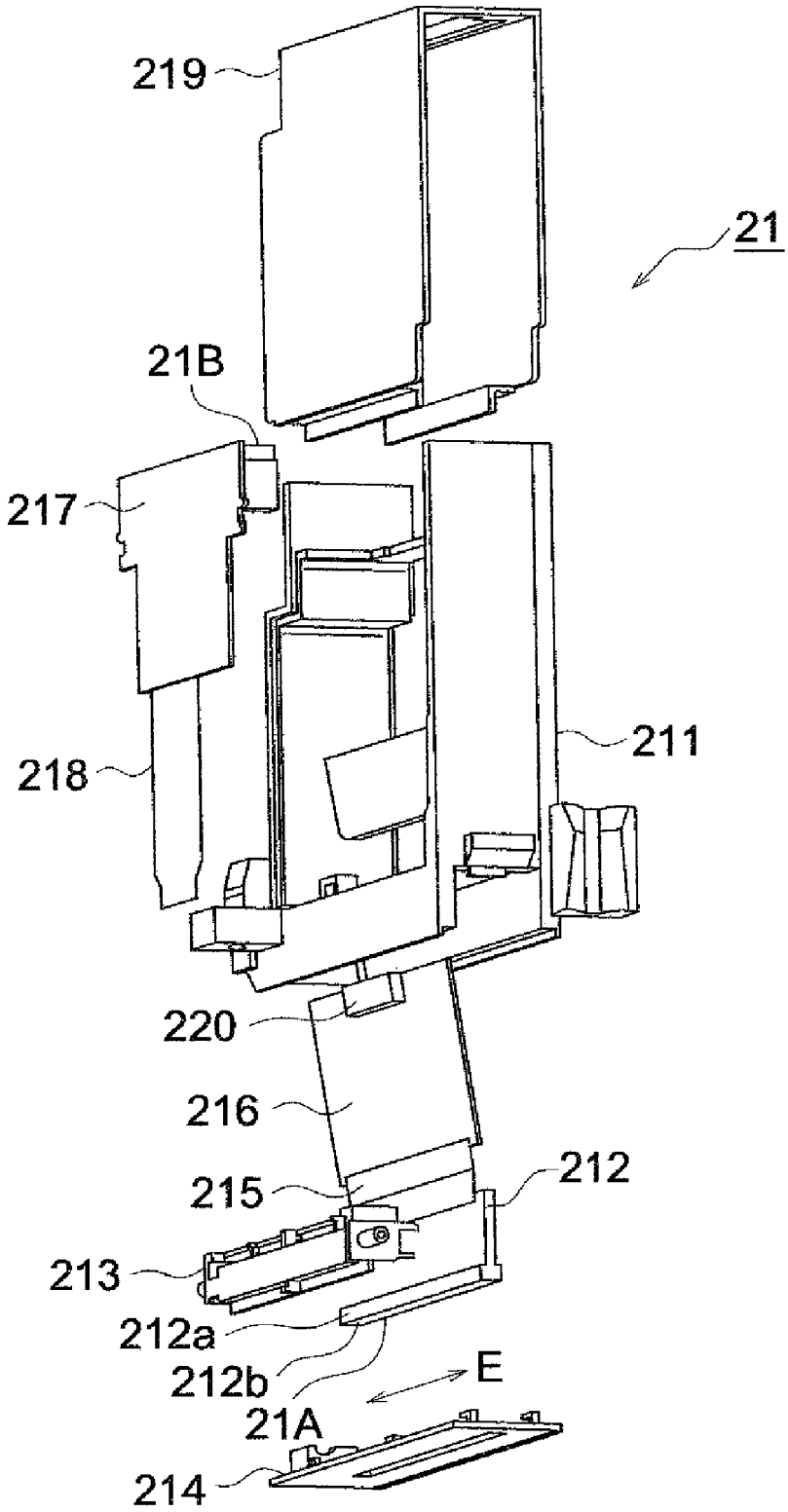
FIG. 3 is an exploded perspective view of a discharging head according to one embodiment of the present invention.

FIG. 3 is an exploded perspective view of the discharging head 21 according to the present embodiment. The discharging head 21 is structured with a casing frame 211, a head chip 212, a manifold 213, a cap receiving plate 214, a flexible wiring board 215, a driving circuit board 216, an external connector 21B, a wiring supporting plate 217, a flexible wiring board 218 and a cover 219.

On the end portion 212*a* of the head chip 212, a great number of nozzles 21A are provided serially in an arrowed direction E. More concretely, a plate (nozzle plate) made of metal or resin and provided with nozzle-shaped holes is pasted on an end face of the end portion 212*a* provided with exits of pressing chambers so that nozzles are provided at a predetermined position of the head chip 212. As a result, nozzles are arranged on the nozzle surface 212*b*. An array of nozzles arranged serially in an arrowed direction E is called a nozzle array. The exits of these nozzles act as discharging ports of a coating liquid. The head chip 212 has an external figure lengthy in an arrowed direction E. The head chip 212 discharges a coating liquid filled in ink flow passages (pressing chambers) formed in its inside from nozzles. At the inlet side of nozzles of the end portion 212*a* of the head chip 212, the ink flow passages (pressing chambers) provided with piezoelectric elements to generate a pressure (discharging power) to discharge ink from the nozzles which are formed corresponding to the respective nozzles. The discharging pressure may be generated by other devices such as heating elements. The piezoelectric elements, which provide a discharging power to each nozzle of the nozzle array, are driven by a driving circuit mounted in a driving circuit board 216. For this driving, the driving circuit board 216 is connected to the head chip 212 via the flexible wiring board 215.

Electrical connection between the driving circuit board 216 and the outside is conducted by an external connector 21B, a flexible wiring board 218 and an internal connector 220. The internal connector 220 is mounted on the driving circuit board 216. External electrodes of the flexible wiring board 218 are connected with the external connector 21B, and one end portion of the flexible wiring board 218 including these external electrodes is pasted and supported on the wiring supporting plate 217. The other end portion of the flexible wiring board 218 is extended from the wiring supporting plate 217 and internal electrodes are formed on the tip end of the other end portion. These internal electrodes are connected with the internal connector 220. When the discharging head 21 is mounted, the external connector 21B is connected with the drive control board 24 installed on the supporting frame 20 via the relay board 22 and the cable 23.

Figure 4:
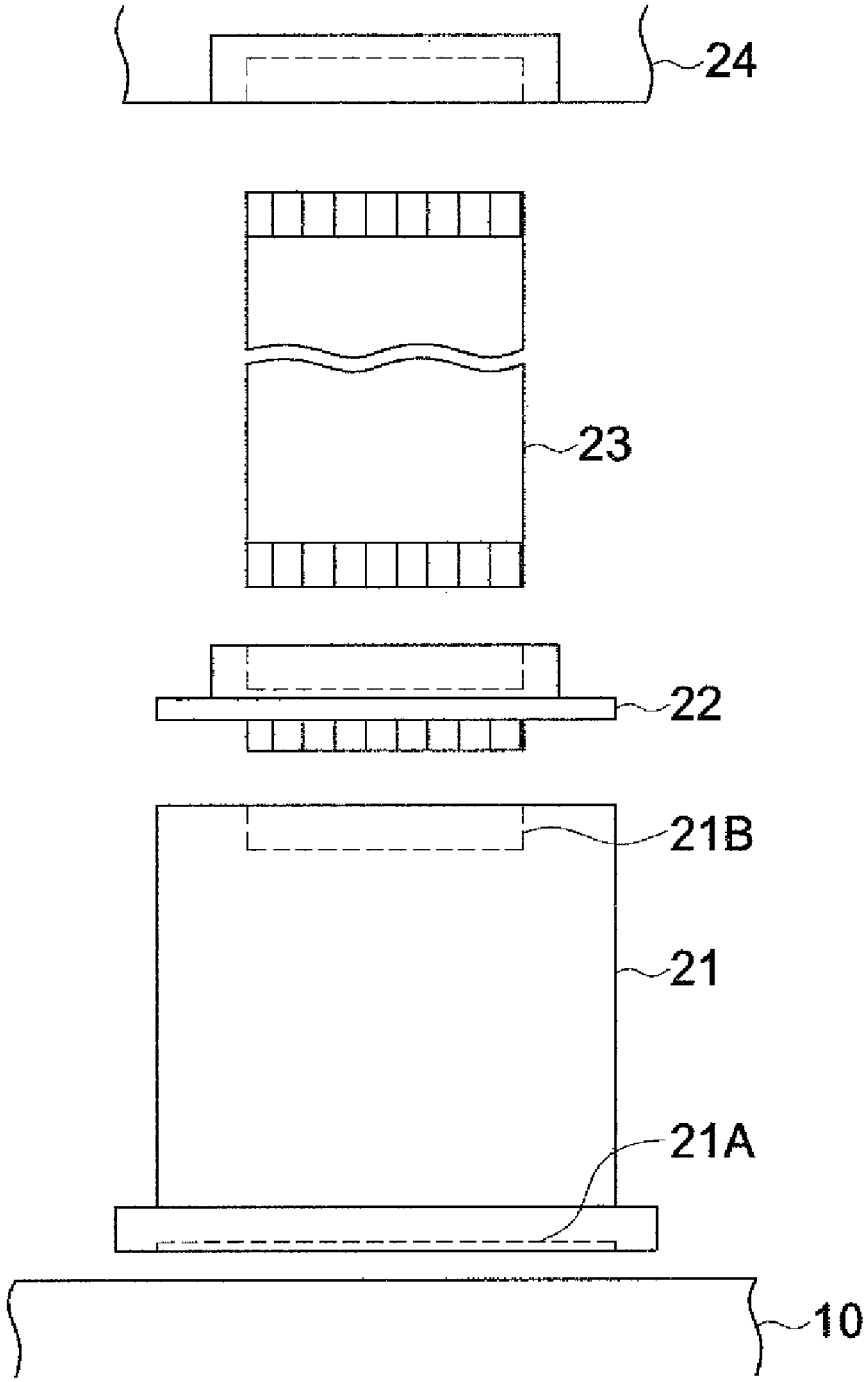
FIG. 4 is a schematic diagram showing a jointing relationship between a discharging head and a drive control board in a situation before jointing.
Figure 5:
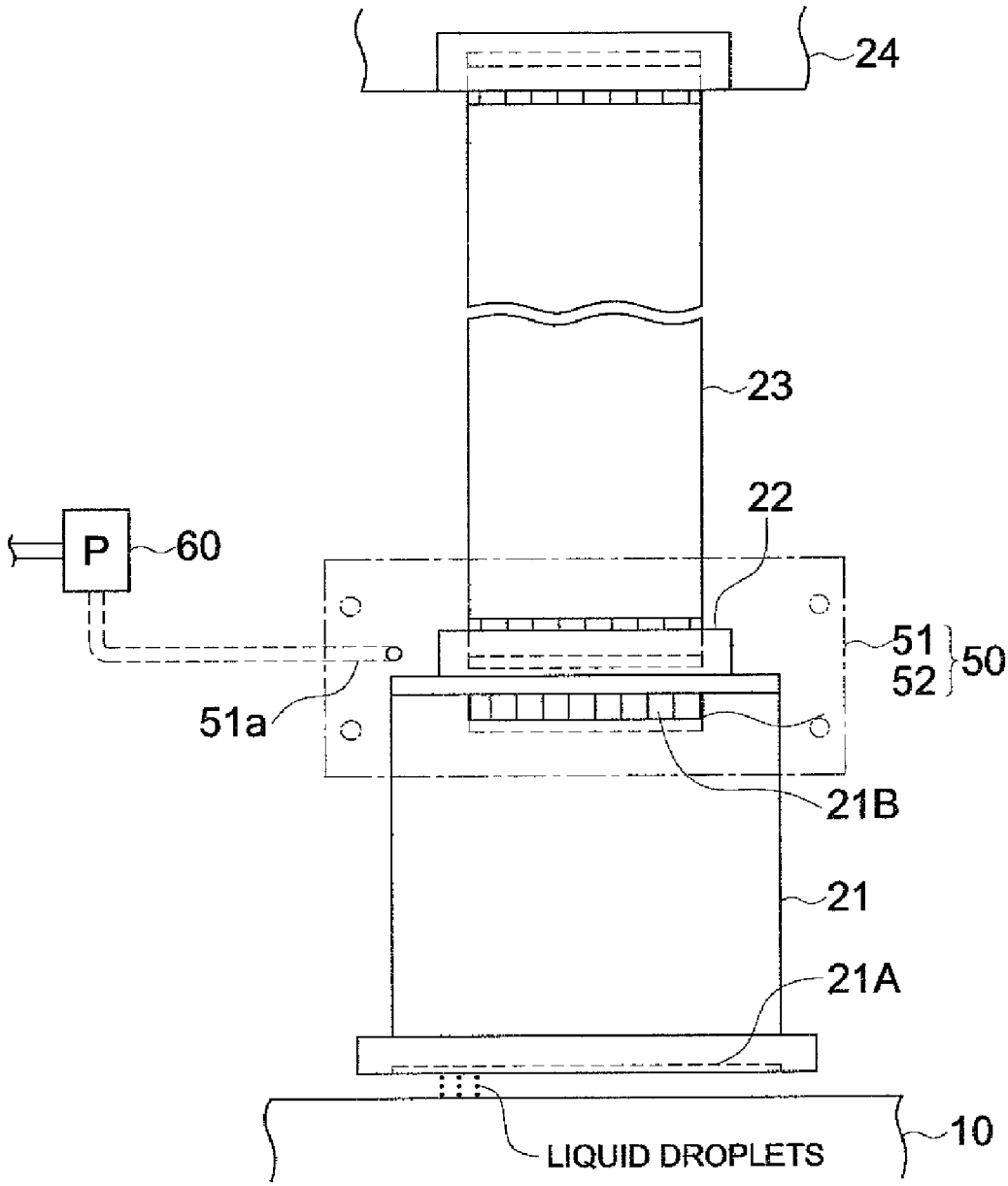
FIG. 5 is a schematic diagram showing a joint situation between a discharging head and a drive control board.

FIG. 4 and FIG. 5 are schematic diagrams showing a jointing between the external connector 21B of the discharging head 21 and the drive control board 24, and FIG. 4 shows the situation before jointing and FIG. 5 shows a jointed situation. As shown in FIG. 5, the external connector 21B is jointed with the relay board 22, the relay board 22 is jointed with the cable 23, and the relay board 22 is jointed with the drive control board 24 respectively.

Next, the intercepting member according the present invention will be explained.

Figure 6:
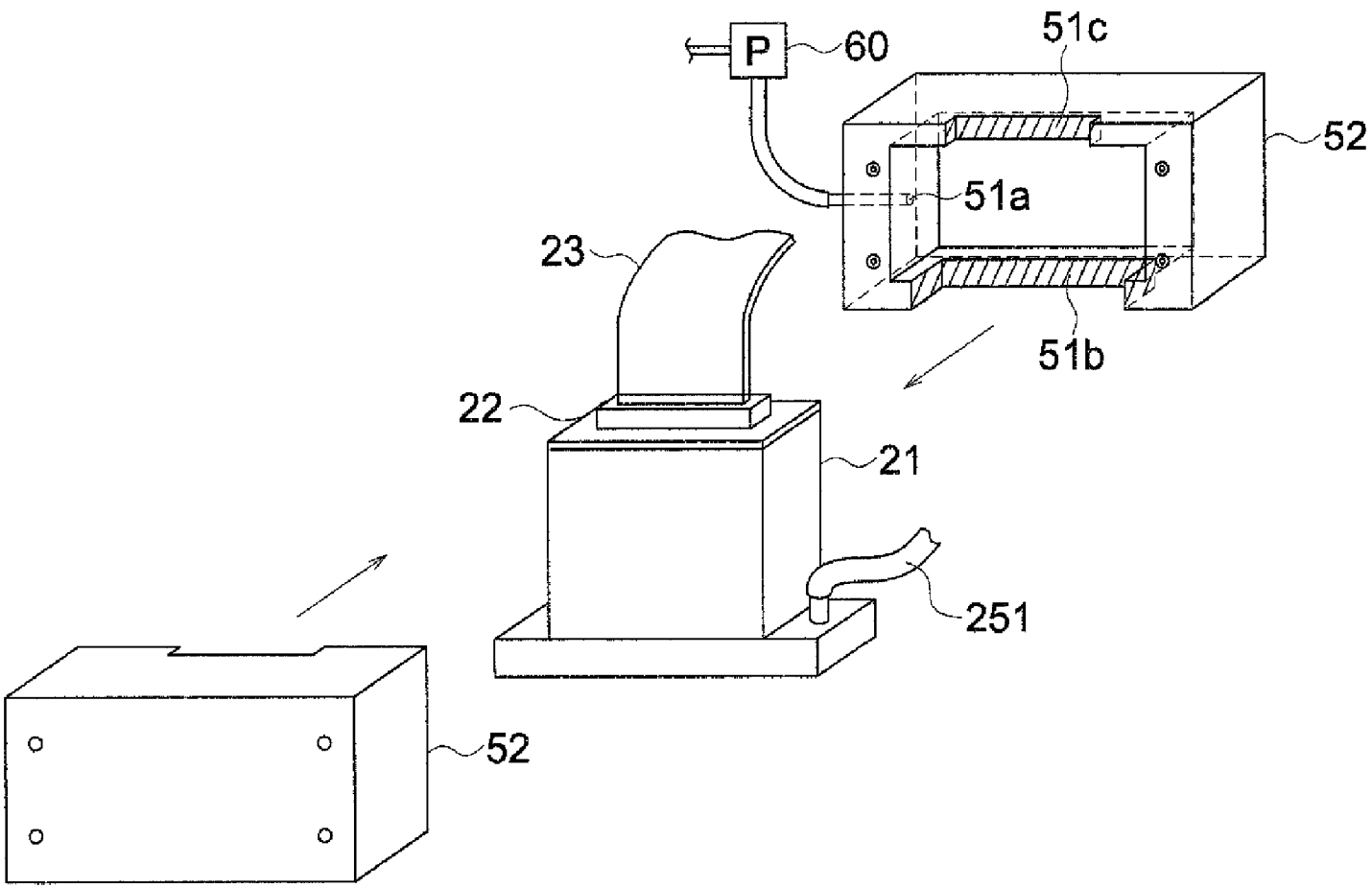
FIG. 6 is a partial perspective view showing a relationship among a discharging head, a cable and an intercepting member.

FIG. 6 is a partial perspective view showing the discharging head 21, the cable 23 and the intercepting member 50 shown in FIG. 5. As shown in FIG. 5 and FIG. 6, the intercepting member 50 is composed of a first casing body 51 and a second casing body 52 which are a hollow casing body with the same shape or the similar shape to each other.

As shown in FIG. 5, the external connector 219, the peripheral relay board 22 and a part of the cable 23 are sandwiched, enclosed and fixed between the first casing body 51 and the second casing body 52 of the intercepting member 50. In this structure, an external surface of the discharging head 21 is sandwiched between a concave portion 51*b* of the first casing body 51 and a concave portion 52*b* (not shown in the drawing) of the second casing body 52, and further an external surface of the cable 23 is sandwiched between a concave portion 51*c* of the first casing body 51 and a concave portion 52*c* (not shown in the drawing) of the second casing body 52, whereby the joint section between the external connector 21B and the relay board 22 and the joint section between the relay board 22 and the cable 23 can be intercepted from becoming in contact with outside air.

As described above, with the structure to intercept the contact between the joint sections and outside air, vapor of a coating liquid can be prevented from coming in contact with the above joint sections. Therefore, it becomes possible to prevent deterioration of electrical connections with electric members of the discharging head 21, the peripheral relay board 22 and the cable 23. Especially, in the case where organic solvent is used for a coating liquid and coating is conducted continuously for a lengthy substrate such as a film having flexibility, it becomes possible to conduct coating stably.

It may be preferable to attach an elastic member such as a rubber to the concave portions 51*b* and 51*c* of the first casing body 51 and the concave portions 52*b* and 52*c* of the second casing body 52. With this structure, the adhesiveness between the external surfaces of the discharging head 21 and the cable 23 and the intercepting member can be enhanced, and then the intercepting effect can be enhanced.

The intercepting member 50 and the elastic member are preferably structured with an insulating material, and more preferably structured with a material having an organic solvent resistance.

Further, as shown in FIG. 5 and FIG. 6, it may be desirable that an air vent hole 51*a* is provided to the first casing body 51 of the intercepting member 50. A filling section 60 is provided to fill a gas in the inside of the intercepting member 50. When the inside of the intercepting member 50 is filled with an inert gas such as nitrogen gas, the penetration prevention of vapor of a coating liquid into the above-mentioned joint sections can be improved. The air vent hole 51*a* may be also provided to the second casing body 52. As the filling section 60, an air supplying pump may be used. Further, the filling of the inert gas may be conducted properly or always.

The intercepting member 50 is not limited to the example of the hollow casing body of the first casing body 51 and the second casing body 52, and may be made a configuration coming in close contact with the joint sections.

With the technique to fill a heat curable resin or a photo curable resin around the joint sections and to cure the resin with head or light, the intercepting member coming in close contact with the joint sections can be made. In this case, the external figure is made to the similar shape to the first casing body 51 and the second casing body and is preferable in a dividable structure. With this structure, the intercepting member can be structured in a form in accordance with the shape of the joint sections, it makes it easy to intercept the outside air and it makes it easy to mount or dismount the intercepting member.

Examples of the heat curable resin include an epoxy resin, a polyester resin and the like. Further, examples of the photo curable resin include visible light ray curable resin, ultraviolet ray curable resin and the like.

As mentioned above, with the intercepting member at the joint section between the discharging head and the relay board and at the joint section between the relay board and the cable, there is an intercept between the joint sections and outside air and vapor of a coating liquid is prevented from coming in contact with the joint sections. This intercept prevents deterioration in electric connection with the electric members of the discharging head and a peripheral drive control board. Especially, in the case where organic solvent is used for a coating liquid and coating is conducted continuously for a lengthy substrate such as a film having flexibility, it becomes possible to conduct coating stably.

The invention claimed is:

1. A coating apparatus for conducting coating by discharging liquid droplets onto a substrate, comprising:

a discharging head having a housing, an external electric terminal which is disposed on an outer surface of the housing and configured to receive control signals, a plurality of nozzles disposed on an outer surface of the housing, and a discharging unit which is incorporated in the housing and configured to receive the control signals via the external electric terminal and to discharge liquid droplets through the plurality of nozzles in response to the control signals;

a drive control board to output the control signals;

a cable having a cable end connected to the drive control board and another cable end a relay board which is located outside of the housing discharging head and has a first electric terminal and a second electric terminal, wherein the first electric terminal is connected to the external electric terminal on the housing so as to form a first electric joint section relative to the external electric terminal and second electric terminal is connected to the another cable end so as to form a second electric joint section relative to the cable so that the control signals are transmitted from the drive control board to the discharging unit via the cable, the second electric joint section, the relay board and the first electric joint section; and an intercepting member located outside of the housing of the discharging head and enclosing the first electric joint section, the second electric joint section and the relay board and intercepting contact between the first electric joint section and outside air and contact between the second electric joint section and outside air.

2. The coating apparatus described in claim 1, wherein the intercepting member is a casing body being hollow.

3. The coating apparatus described in claim 2, wherein the casing body is structured to enclose the first electric joint section, the relay board and the second electric joint section.

4. The coating apparatus described in claim 2, wherein the casing body is made of an insulating material.

5. The coating apparatus described in claim 2, wherein the inside of the casing body is filled with an inert gas.

6. The coating apparatus described in claim 2, wherein the casing body is divided into a first casing half body and a second casing half body.

7. The coating apparatus described in claim 1, wherein the intercepting member is a block made of a heat curable insulating resin or a light curable insulating resin.

8. The coating apparatus described in claim 7, wherein the block is structured to enclose the first electric joint section, the relay board and the second electric joint section.

9. The coating apparatus described in claim 7, wherein the block is divided into a first half block and a second half block.

* * * * *